United States Patent [19]

Zegers

[11] Patent Number: 4,927,218

[45] Date of Patent: May 22, 1990

[54] FLAT DISPLAY TUBE COMPRISING AN EMISSION SYSTEM FOR EMITTING A PLANAR ELECTRON BEAM, A DEFLECTION SYSTEM AND A MODULATION SYSTEM

[75] Inventor: Antonius P. F. Zegers, Eindhoven, Netherlands

[73] Assignee: U.S. Philips Corporation, New York, N.Y.

[21] Appl. No.: 320,134

[22] Filed: Mar. 6, 1989

[30] Foreign Application Priority Data

Mar. 7, 1988 [NL] Netherlands ..... 8800554

[51] Int. Cl.[5] ..... H01J 29/70; H01J 29/72

[52] U.S. Cl. ..... 315/366; 313/422

[58] Field of Search ..... 315/366; 313/422

[56] References Cited

U.S. PATENT DOCUMENTS 4,451,852 5/1984 Masuda et al. ..... 315/366

4,626,899 12/1986 Tomii et al. ..... 315/366

*Primary Examiner*—Theodore M. Blum

*Attorney, Agent, or Firm*—Robert J. Kraus

[57] ABSTRACT

A flat display tube comprising an emission system (3) for emitting a planar electron beam (20), a modulation system (22) and a deflection system (5*a*, 5*b*, 28) for deflecting the planar electron beam towards the modulation system (22), which flat display tube also comprises a selection system (23) for selecting the planar electron beam transversely to this beam. The thickness of the electron beam (20) is increased by mutual repulsion of the electrons in the planar electron beam. The selection system in the flat display tube precludes that this adversely affects the resolution of the picture on the display screen.

4 Claims, 6 Drawing Sheets

FLAT DISPLAY TUBE COMPRISING AN EMISSION SYSTEM FOR EMITTING A PLANAR ELECTRON BEAM, A DEFLECTION SYSTEM AND A MODULATION SYSTEM

BACKGROUND OF THE INVENTION

The invention relates to a flat display tube comprising an evacuated envelope which is provided with a display window, a phosphorescent display screen being present on the display window in the evacuated envelope, an emission system for emitting a planar electron beam which initially extends substantially parallel to the display screen, a modulation system for modulating the planar electron beam, which modulation system extends substantially parallel to the display screen, and a deflection system for deflecting the planar electron beam towards the modulation system.

Such a flat display tube is known from U.S. Patent Specification 4,626,899. In the Patent Specification, a description is given of a flat display tube which comprises an electron gun at the side of the display screen, which electron gun emits in operation the planar electron beam in a plane which is substantially parallel to the display screen. This electron gun is provided with a pair of deflection electrodes which extend on either side of the electron beam, and which in cooperation with a planar electrode extending parallel to the modulation system deflect the planar electron beam such that the beam is substantially transversely incident on the modulation system. The location where the planar electron beam is incident on the modulation system is varied by changing the voltages applied to the deflection and planar electrode(s), and the display screen is scanned in a direction transverse to the planar electron beam. The modulation system is controlled by a video signal. By means of this modulation system, the display screen is scanned in a direction transverse to the above-said direction, i.e., in the plane of the planar electron beam.

An important aspect of the picture display quality is the definition. In the known display tube the picture definition in a direction transverse to the planar electron beam is determined by the thickness of the planar electron beam. In order to deflect the planar electron beam in the relatively small space in a flat display tube, preferably, a relatively low-energy electron beam is emitted. By mutual repulsion of the electrons in the planar electron beam, the thickness of the planar electron beam is increased, thereby reducing the picture definition, which is important to, in particular, low-energy electron beams. Low-energy electron beams are to be understood to mean herein, in particular, electron beams comprising electrons having a kinetic energy of less than approximately 3 KeV.

SUMMARY OF THE INVENTION

It is an object of the invention to improve the picture definition in the direction transverse to the planar electron beam.

To this end, the invention is characterized in that the flat display tube comprises a selection system for selecting the electron beam in a direction transverse to the planar electron beam. Due to this selection system, the picture definition is determined in a direction transverse to the planar electron beam.

In an embodiment the selection system is provided with a repetitive pattern of groups of electrodes which extend parallel to the planar electron beam and which are provided with an aperture or apertures for allowing electrons to pass, corresponding elements of the groups being connected to one another and to means for applying a control voltage. In this manner, the number of connections is reduced.

In a preferred embodiment each group comprises two electrodes. The number of connections is then reduced to the extent possible.

BRIEF DESCRIPTION OF THE DRAWINGS

The invention will now be explained in greater detail by means of a few exemplary embodiments and with reference to a drawing, in which.

The Figures are diagrammatic and not drawn to scale, corresponding parts of the different embodiments generally bearing the same reference numerals.

DESCRIPTION OF THE PREFERRED EMBODIMENTS

Figure 1:
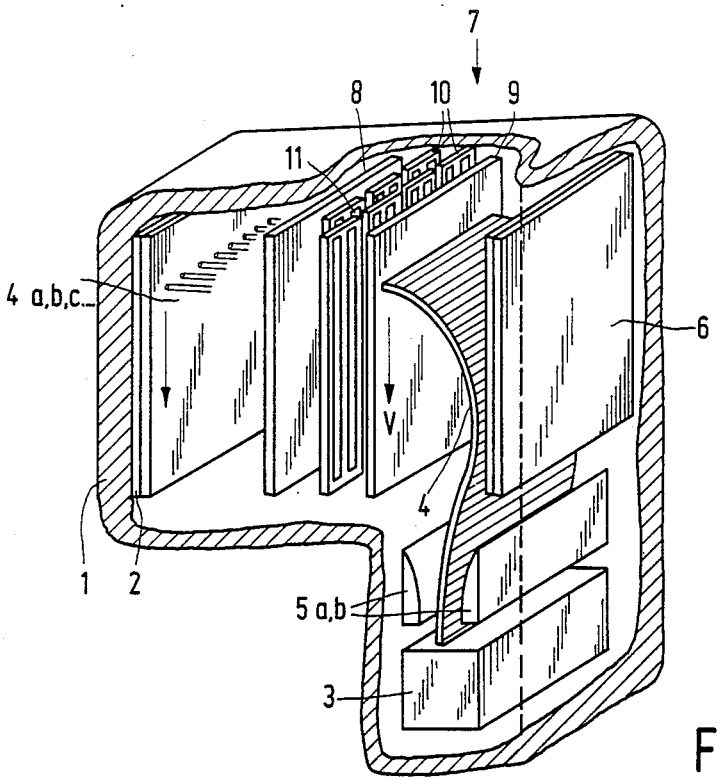
FIG. 1 is a partly perspective elevational view of a known display tube.

FIG. 1 is a partly perspective elevational view of a known display tube. Display window 1 of the not completely shown evacuated envelope is provided on the inside with a phosphorescent screen 2. An emission system, in the present example an electron gun 3, emits a planar electron beam 4. Deflection electrodes 5*a* and 5*b* and a planar electrode 6 deflect the planar electron beam 4 towards a modulation system 7, such that the planar electron beam 4 is transversely incident on the modulation system 7. The known display tube comprises two grids 8 and 9 which are located at the entrance and exit sides of the modulation system 7 which comprises a system of modulation electrodes 10. These modulation electrodes 10 are provided with apertures 11. By selecting the voltages which are applied to the modulation electrodes 10, the planar electron beam 4 is modulated so as to form a number of linear electron beams 4*a*, 4*b* etc., the power of which is also determined by the voltages applied to the modulation electrodes 10. In this manner, a line of the picture is formed on the display screen.

The picture definition in a direction transverse to the plane through the electron beams 4*a*, 4*b* etc. is also governed by the thickness of the electron beams.

Figure 2:
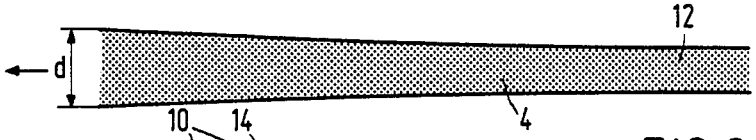
FIG. 2 is a cross-sectional view of a planar electron beam.

FIG. 2 is a cross-sectional view of a planar electron beam 4 and schematically shows how mutual repulsion of the electrons influences the width of the planar electron beam 4. The electrons 12 in the planar electron beam 4 mutually repel one another. This leads to an increase of the thickness d of the planar electron beam.

This increase becomes more significant as the electron density and the time during which the repulsion takes place increase. This effect is more important in low-energy electron beams than in high-energy electron beams because the time between the emission of the electrons and the moment that the electrons are incident on the display screen increases as the kinetic energy of the electrons decreases. The distance between the emission system and the display screen to be covered by the electrons in the electron beam depends on the line on the display screen which is scanned. Consequently, the broadening of the planar electron beam is not the same everywhere on the display screen.

Figure 3:
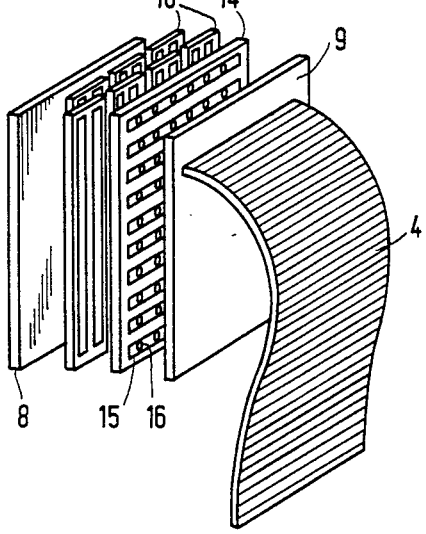
FIG. 3 is a partly perspective elevational view of a detail of a flat display tube in accordance with the invention.

Details of a flat display tube in accordance with the invention are shown in FIG. 3. A selection system 14 is arranged between the grid 9 and the system of modulation electrodes 10. This selection system 14 comprises a number of electrodes 15 which are parallel to the planar electron beam 4 and which are provided with apertures 16. The apertures 16 may be circular or they may alternatively have a different shape, for example oval or rectangular.

Figure 4:
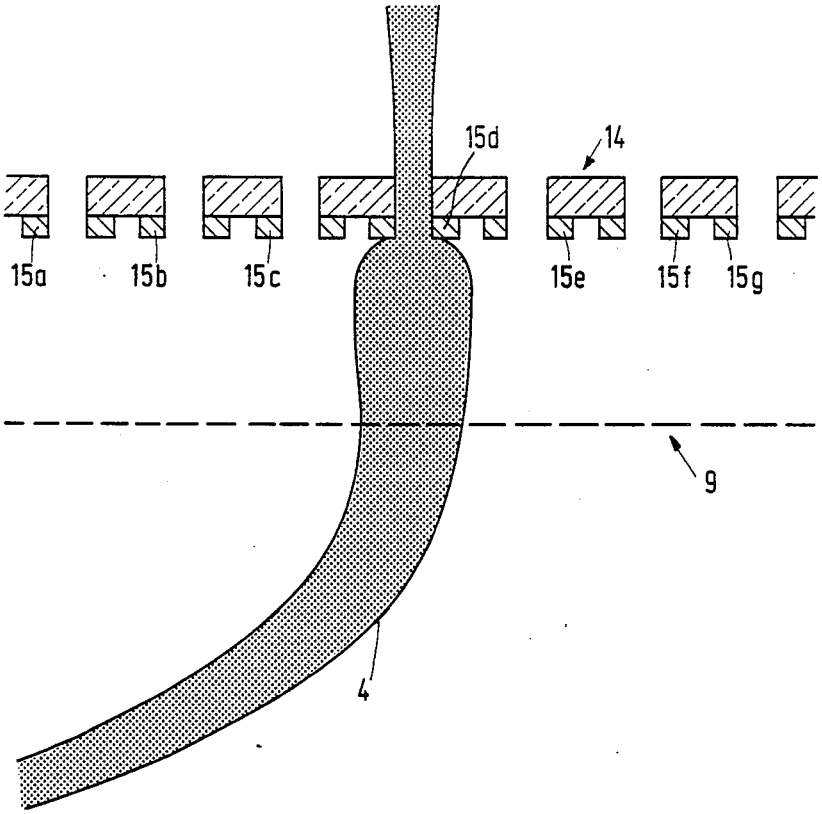
FIGS. 4, 5*a*, 6*a* and 7 are cross-sectional views of a detail of a flat display tube in accordance with the invention.

FIG. 4 shows the planar electron beam 4 and a part of the selection system 14. Electrode 15*a* up to and including c and e up to and including g are at a potential which is below the potential of grid 9, electrode 15*d* is at a potential which is higher than that of grid 9. Grid 9 may be a wire grid and is generally highly transparent to the electron beam 4. The electron beam 4 can only pass through the apertures in electrode 15*d*, so that the thickness of the electron beam 4 is determined. It is possible to energize each electrode of selection system 14 separately by means of a control voltage, however, this is not necessary.

Figure 5A:
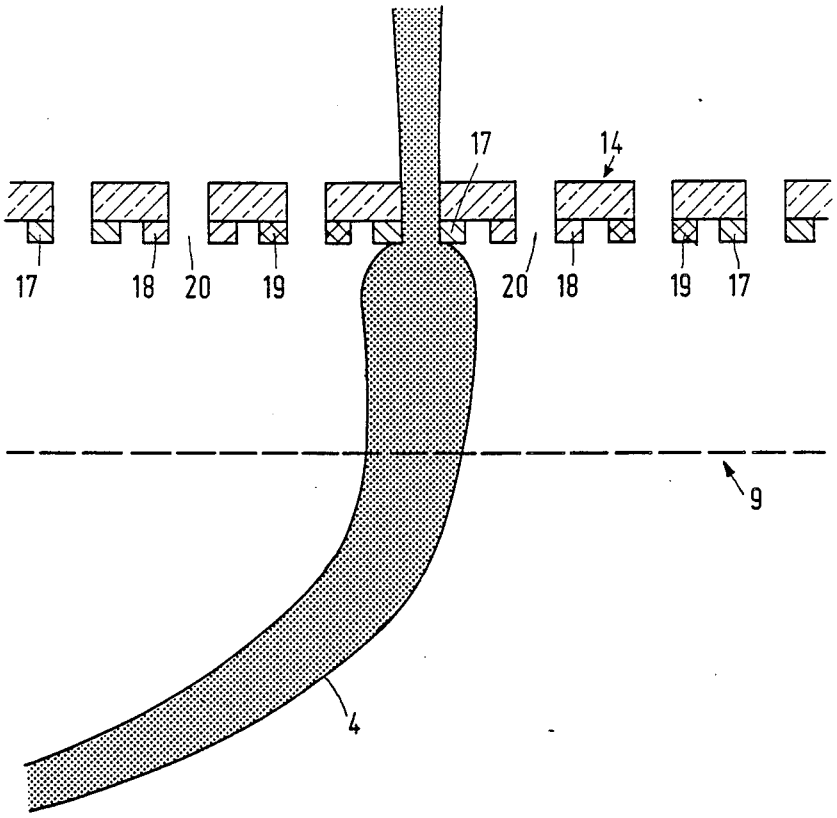
Figure 5B:
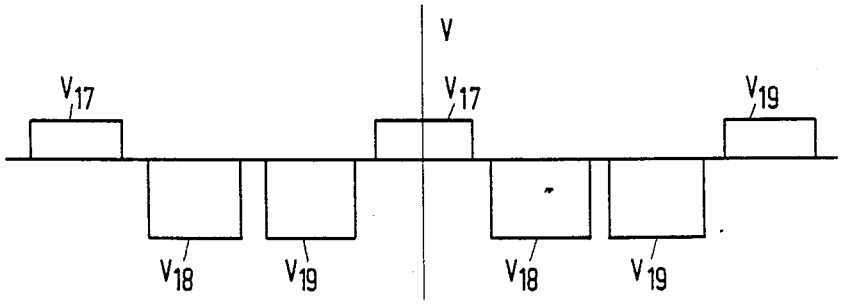
FIGS. 5*b* and 6B are graphic representations of the voltage applied to the electrodes of the selection system.
Figure 6A:
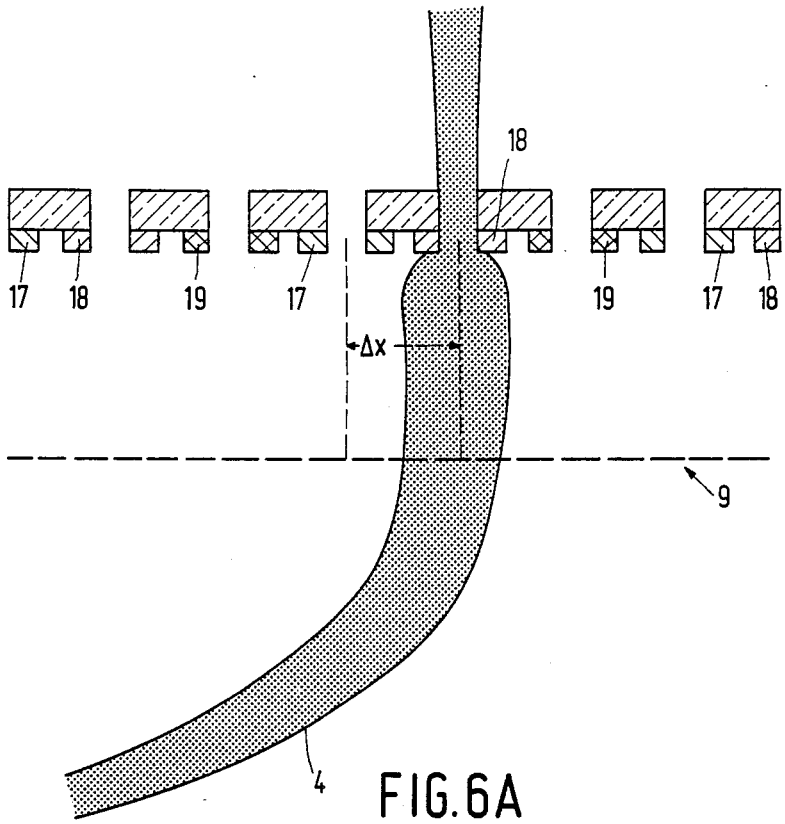
Figure 6B:
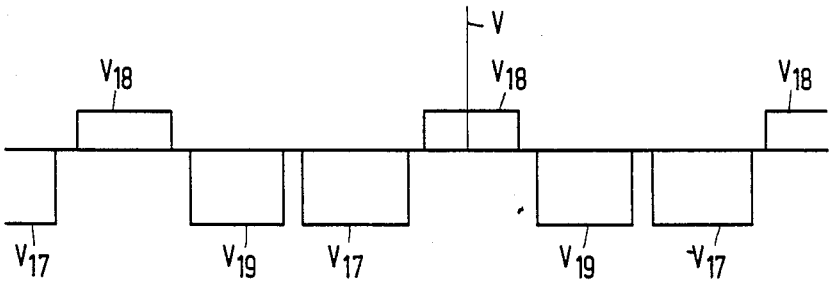

FIG. 5*a* is a sectional view of a further embodiment of a selection system 14, which extends transversely to the planar electron beam 4. The electrodes of the selection system are arranged in accordance with a repetitive pattern of groups, in the present example trios, of electrodes (17, 18, 19) which extend parallel to the planar electron beam 4 and which are provided, in the present example, with elongated apertures 20, corresponding elements of the groups being connected to one another. In the present example, each trio of electrodes comprises the electrodes 17, 18 and 19, which are energized by control voltages $V_{17}$, $V_{18}$ and $V_{19}$, respectively. FIG. 5*a* also is a sectional view of the planar electron beam 4. FIG. 5*b* is a diagrammatic representation of the voltages applied to the electrodes 17, 18 and 19 relative to the voltage applied to the grid 9 at a randomly selected time $t_1$. The electron beam 4 passes through only one of the electrodes of the selection system 14, in the present Figure one of the electrodes 17. FIGS. 6*a* and 6*b* represent the situation at a time $t_1+\Delta t$. The electron beam 4 is displaced over a distance $\Delta x$, $\Delta x$ being equal to the distance between two electrodes of the selection system 14; as is shown in FIG. 6*b*, the voltages applied to the electrodes have been changed relative to the situation shown in FIG. 5*b*. Also in this case, the electron beam 4 passes through only one of the electrodes of the selection system 14, in this case through one of the electrodes 18. In the FIGS. 4, 5 and 6, the potentials applied to the electrodes 15*a* up to and including g, 17, 18 and 19 also have a focussing effect, i.e. the electrons are drawn into the aperture in electrode 15*d* (FIG. 4*a*), 17 (FIG. 5*a*) and 18 (FIG. 6*a*), respectively.

Figure 7:
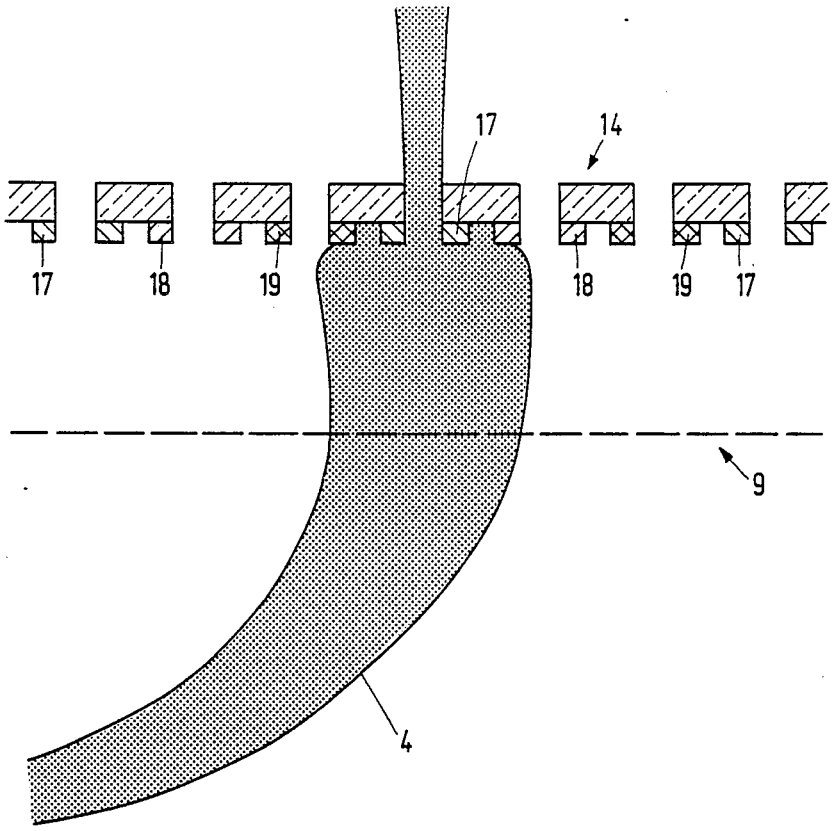

In FIGS. 4, 5 and 6 the thickness d of the electron beam 4 is not much larger than the distance between the electrodes. The advantage of the invention becomes particularly manifest if the thickness of the planar electron beam exceeds the distance between the electrodes. This may occur, for example, when the electron density in the electron beam is very high or when the electron beam has covered a long path. FIG. 7 shows a planar electron beam 4, the thickness d of which exceeds than the distance between the electrodes. The positive voltages which are applied to the electrodes 18 and 19 preclude electrons from passing through the apertures in these electrodes. Only for electrodes 17 the potential is selected such that electrons can pass through the apertures in these electrodes. This Figure clearly shows that a further broadening of the electron beam 4 may lead to a situation in which several apertures in the electrons 17 or 18 or 19 allow parts of the electron beam 4 to pass. If this is possible, the number of electrodes in one group can be increased. In general it is to be preferred that the distance between corresponding electrodes of neighbouring groups of electrodes is larger than the maximum width of the electron beam, so that there is always only one aperture which allows electrons to pass. If possible each group preferably comprises two electrodes. In this case, the total number of connections is reduced to the extent possible.

Figure 8A:
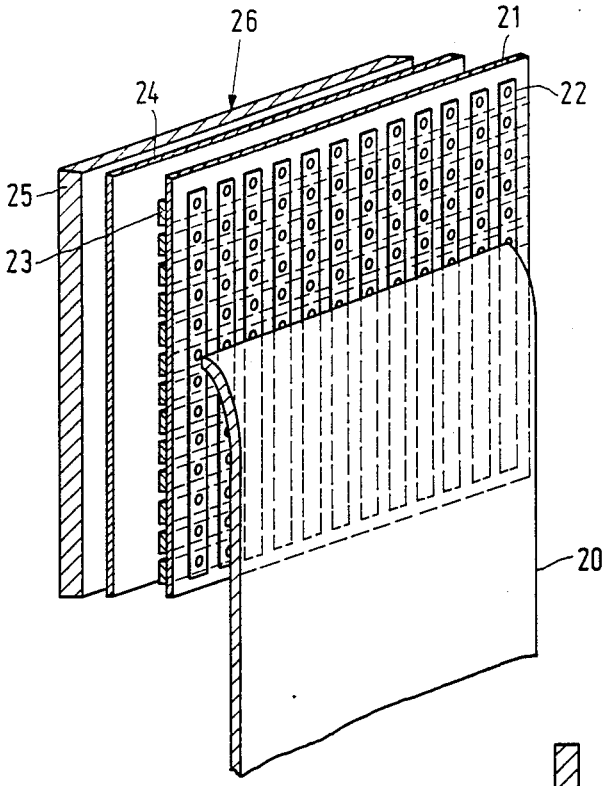
FIG. 8*a* is a partly perspective elevational view of details of another embodiment of a flat display tube in accordance with the invention.
Figure 8B:
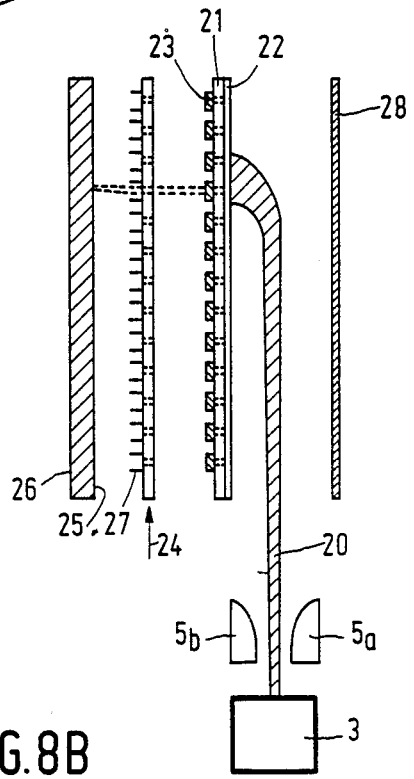
FIG. 8*b* is a cross-sectional view of the details shown in FIG. 8*a*.

In the examples of the invention described herein before, the flat display tube has the grid 9. In these examples, the selection system is disposed in front of the modulation system. This is not to be regarded as a feature which limits the scope of the invention. FIGS. 8*a* and 8*b* are a partly perspective elevational view and a cross-sectional view, respectively, of details of another example of a flat display tube in accordance with the invention. A planar electron beam emitted by the emission system 3 is deflected towards a carrier 21 by means of the deflection electrodes 5*a*, 5*b* and a planar electrode 28, which carrier supports a modulation system 22 on the side facing deflection system 28. This modulation system 22 comprises a number of parallel disposed electrodes in which apertures are formed. A selection system 23 comprising a number of parallel disposed electrodes in which apertures are formed, is arranged on the side of the carrier 21 remote from the deflection system 28. A colour selection system 24 comprising a carrier which is provided with colour selection electrodes 27 on the side facing the display screen is arranged between the carrier 21 and a display window 26 which is provided with a display screen 25. FIG. 8*b* is a cross-sectional view of various electrode systems. FIG. 8*b* clearly shows that despite the width of the planar electron beam only one picture element is excited.

It will be understood that within the scope of the invention many variations are possible to those skilled in the art.

What is claimed is:

1. A flat display tube comprising an evacuated envelope which is provided with a display window, a phosphorescent display screen being present on the display window in the evacuated envelope, an emission system for emitting a planar electron beam which initially extends substantially parallel to the display screen, a modulation system for modulating the planar electron beam, which modulation system extends substantially parallel to the display screen, and a deflection system for deflecting the planar electron beam towards the modulation system, characterized in that the flat display tube comprises a selection system for selecting the electron beam in a direction transverse to the planar electron beam.

2. A flat display tube as claimed in claim 1, characterized in that the selection system is provided with a repetitive pattern of groups of electrodes which extend parallel to the planar electron beam and which are provided with an aperture or apertures for allowing electrons to pass, corresponding elements of the groups being connected to one another and to means for applying a control voltage.

3. A flat display tube as claimed in claim 2, characterized in that each group comprises two electrodes.

4. A flat display tube as claimed in claim 2 or 3, characterized in that the distance between corresponding electrodes of neighbouring groups of electrodes is larger than the maximum width of the electron beam.

* * * * *